US010818210B2

(12) United States Patent
Ma et al.

(10) Patent No.: US 10,818,210 B2
(45) Date of Patent: Oct. 27, 2020

(54) DISPLAY APPARATUS AND BRIGHTNESS UNIFORMITY COMPENSATION METHOD THEREOF

(71) Applicant: Novatek Microelectronics Corp., Hsinchu (TW)

(72) Inventors: Wei-Jhe Ma, Hsinchu (TW); Yung-Cheng Tsai, Hsinchu (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/262,934

(22) Filed: Jan. 31, 2019

(65) Prior Publication Data

US 2020/0251033 A1 Aug. 6, 2020

(51) Int. Cl.
*G09G 3/20* (2006.01)

(52) U.S. Cl.
CPC ..... *G09G 3/20* (2013.01); *G09G 2320/0233* (2013.01); *G09G 2320/0276* (2013.01); *G09G 2320/0285* (2013.01); *G09G 2360/16* (2013.01)

(58) Field of Classification Search
CPC ..... G09G 3/20; G09G 2320/0233; G09G 2320/0276; G09G 2320/0285; G09G 2360/16
See application file for complete search history.

(56) References Cited

U.S. PATENT DOCUMENTS

2007/0146384 A1* 6/2007 Jo ..... G09G 3/20 345/589
2008/0024398 A1* 1/2008 Hwang ..... G09G 3/20 345/60
2011/0007090 A1* 1/2011 Chung ..... G09G 3/3648 345/596
2011/0148941 A1* 6/2011 Kim ..... G09G 3/3426 345/690
2012/0086713 A1* 4/2012 Cho ..... G09G 3/003 345/419
2016/0117982 A1 4/2016 Fujii
2016/0163252 A1* 6/2016 Sugiyama ..... G09G 3/006 345/589
2016/0307511 A1 10/2016 Fujii
2019/0059156 A1* 2/2019 Kwon ..... H05K 1/118
2019/0064597 A1* 2/2019 Wan ..... G09G 3/3426

* cited by examiner

*Primary Examiner* — Sejoon Ahn
(74) *Attorney, Agent, or Firm* — JCIPRNET

(57) ABSTRACT

A display apparatus and a brightness uniformity compensation method are introduced. The display apparatus includes a display panel, a content analysis circuit, a compensation table generator and a pixel compensation circuit. The content analysis circuit receives display data for a pixel of the display panel and analyzes a display load of the display data to generate a data compensation value. The compensation table generator generates a compensation table that includes the data compensation value corresponding to the display data of each pixel of the display panel. The pixel compensation circuit compensates the display data with the corresponding data compensation value included in the compensation table to generate compensated display data, wherein the compensated display data are displayed on the display panel of the display apparatus.

14 Claims, 12 Drawing Sheets

DISPLAY APPARATUS AND BRIGHTNESS UNIFORMITY COMPENSATION METHOD THEREOF

BACKGROUND

Technical Field

The disclosure generally relates data compensation, and more particularly relates to a display apparatus and a brightness uniformity compensation method that are capable of compensating brightness non-uniformity caused by a voltage drop across a display panel of the display apparatus.

Description of Related Art

A display panel is driven according to display data to display desired display content. For current display panels, the same display data may be perceived differently in term of brightness (brightness non-uniformity) because of a voltage drop across parasitic resistances of a supply power line of the display panel. The brightness non-uniformity is more severe for high resolution and large size display panel.

Therefore, it would be desirable to efficiently compensate the brightness non-uniformity on the display panel of a display apparatus.

Nothing herein should be construed as an admission of knowledge in the prior art of any portion of the present disclosure.

SUMMARY

A display apparatus and a brightness uniformity compensation method that are capable of compensating brightness non-uniformity in a display panel are introduced.

In an embodiment of the disclosure, the display apparatus includes a display panel, a content analysis circuit, a compensation table generator and a pixel compensation circuit. The content analysis circuit receives display data for a pixel of the display panel and analyzes a display load of the display data to generate a data compensation value. The compensation table generator generates a compensation table that includes the data compensation value corresponding to the display data of each pixel of the display panel. The pixel compensation circuit compensates the display data with the corresponding data compensation value included in the compensation table to generate compensated display data, wherein the compensated display data are displayed on the display panel of the display apparatus.

In another embodiment of the disclosure, the display apparatus includes a display panel, a content analysis circuit, a compensation circuit and a gamma generator. The content analysis circuit analyzes a display load of display data to generate a compensation value for each pixel of the display panel. The compensation circuit generates a plurality of compensated values according to the compensation value. The gamma generator is coupled to the compensation circuit and is configured to generate compensated gamma reference voltages according to the compensated values, wherein the compensated gamma reference voltages are used to generate compensated display data to be displayed on the display panel.

In an embodiment of the disclosure, the brightness uniformity compensation method includes steps of receiving display data for a pixel of the display panel; analyzing a display load of the display data to generate a data compensation value; generating a compensation table that includes the data compensation value corresponding to the display data of each pixel of the display panel; and compensating the display data with the corresponding data compensation value included in the compensation table to generate compensated display data, wherein the compensated display data are displayed on the display panel.

In another embodiment of the disclosure, the brightness uniformity compensation method includes steps of receiving display data for a pixel of the display panel; analyzing a display load of the display data to generate a compensation value; generating a plurality of compensated values according to the compensation value; and generating compensated gamma reference voltages according to the compensated values, wherein the compensated gamma reference voltages are used to generate compensated display data to be displayed on the display panel.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
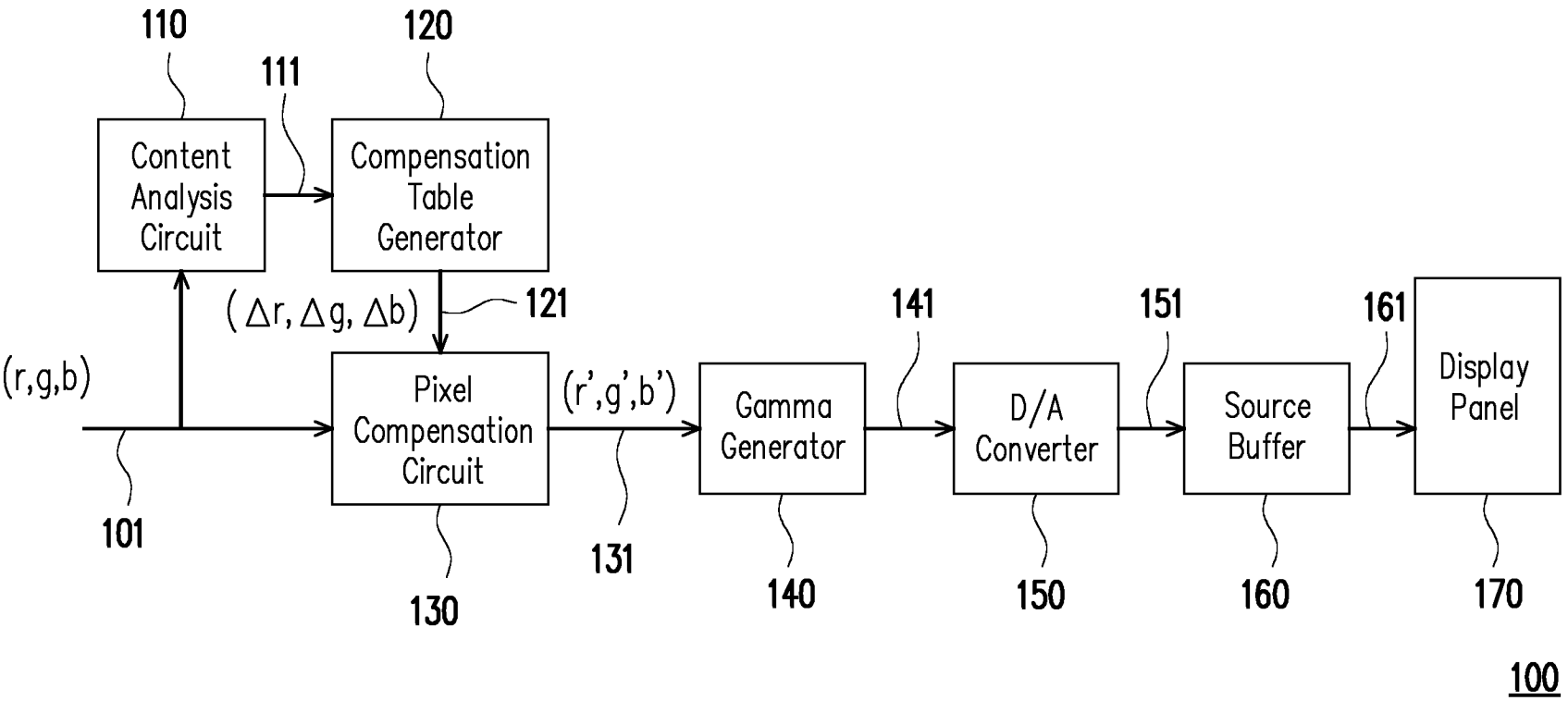
FIG. 1 illustrates a schematic diagram of a display apparatus according to an embodiment of the disclosure.

Referring to FIG. 1, a display apparatus 100 includes a content analysis circuit 110, a compensation table generator 120, a pixel compensation circuit 130, a gamma generator 140, a digital-to-analog converter (DAC) 150, a source buffer 160 and a display panel 170. The display panel 170 includes a plurality of pixels (not shown), where each pixel of the display panel is driven according to display data. In an embodiment, each pixel of the display panel may include a red sub-pixel, green sub-pixel and blue sub-pixel for displaying red data (red grayscale value), green data (red grayscale value) and blue data (red grayscale value) of the display data.

The content analysis circuit 110 receives display data 101 and analyzes content of the display data 101 to generate a data compensation value 111. For example, the content analysis circuit 110 may analyze a display load of the display data 101, where the display load of a pixel display data depends on the parasitic resistance of the supply power line from a power supply source to a location of the pixel. In other words, the display load of a pixel is greater as the location of the pixel is farther from the power supply source. The compensation value 111 is used to compensate the display data 101 to generate compensated display data, where the compensated display data may prevent or alleviate the brightness non-uniformity because of a voltage drop across the parasitic resistance of the supply power line in the display panel 170. In an embodiment of the disclosure, the data compensation value 111 for each of the pixels comprises a red compensation value Δr, a blue compensation value Δb and a green compensation value Δg for compensating red data, blue data and green data of the display data 101.

The compensation table generator 120 is coupled to the content analysis circuit 110 and is configured to generate a compensation table based on the data compensation value 111. The compensation table includes the data compensation value 111 for each of the pixels in the display panel 170. In an example, the compensation table stores the red compensation value Δr, blue compensation value Δb and green compensation value Δg corresponding to each pixel of the display panel 170.

Figure 2:
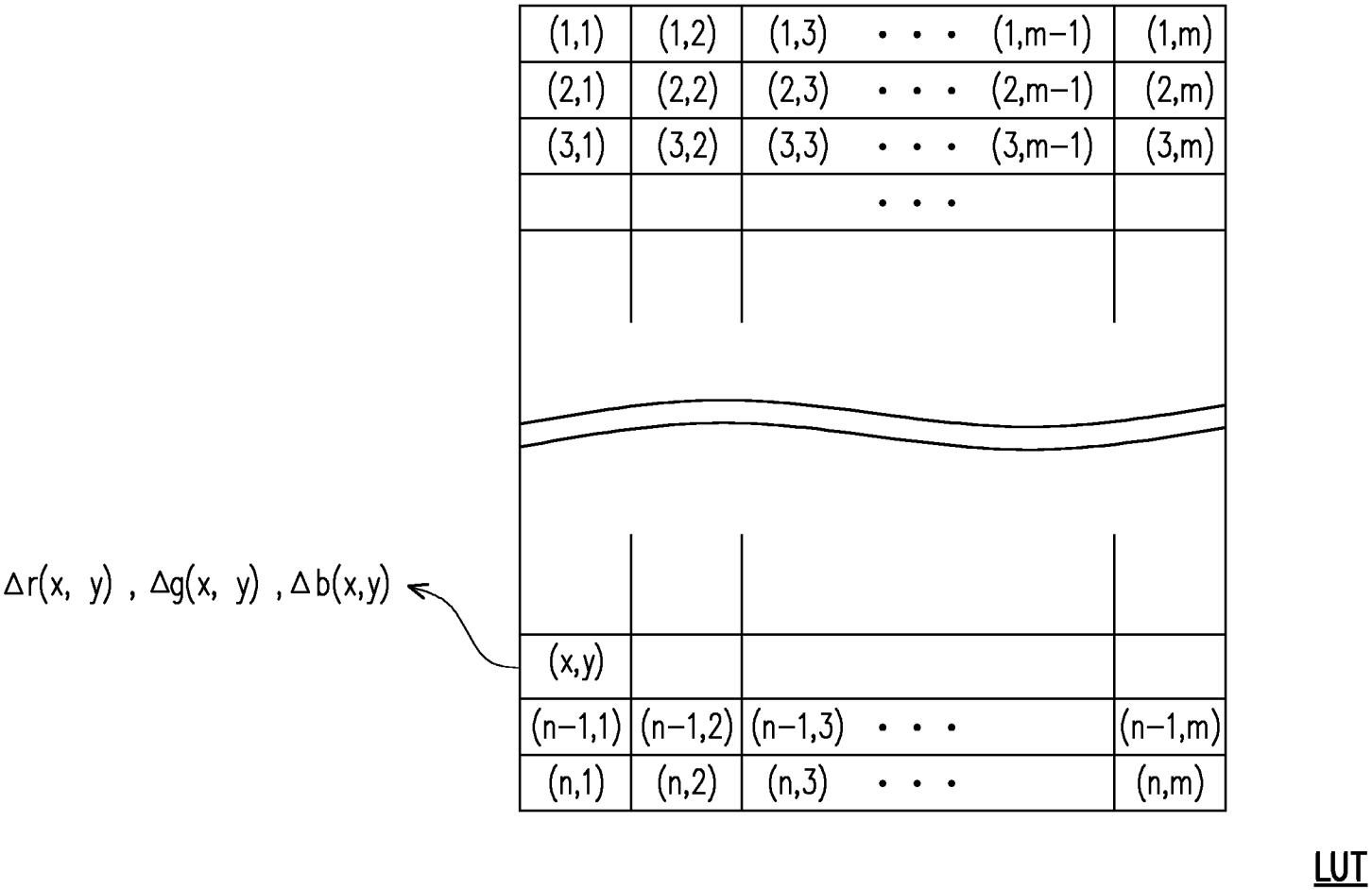
FIG. 2 illustrates an exemplary compensation table generated by a display apparatus according to an embodiment of the disclosure.

An exemplary compensation table LUT is shown in FIG. 2. The compensation table LUT stores the data compensation values for the pixels of the display panel 170. For example, the compensation table LUT stores the compensation values Δr(x,y), Δg(x,y), Δb(x,y) for the display data r(x,y), g(x,y) and b(x,y) at the location (x, y) of the compensation table LUT. In this way, the data compensation values may be quickly and efficiently stored and read out for compensating the pixels of the display panel 170.

The pixel compensation circuit 130 is coupled to the compensation table generator 120 to receive the compensation values stored in the compensation table LUT. The pixel compensation circuit 130 is configured to compensate the display data (r, g, b) of each of the pixels with the corresponding data compensation value (Δr, Δg, Δb) to generate the compensated display data (r', g', b'). In an example, the compensated display data of a pixel (x,y) is calculated according to the following equations (1) to (3):

$$r'(x,y)=r(x,y)+\Delta r(x,y) \quad (1)$$

$$g'(x,y)=g(x,y)+\Delta g(x,y) \quad (2)$$

$$b'(x,y)=b(x,y)+\Delta b(x,y) \quad (3)$$

The gamma generator 140 is coupled to the pixel compensation circuit 130, and is configured to generate a plurality of gamma codes, where the gamma codes are used to generate a plurality of gamma reference voltages 141. The gamma reference voltages 141 may be provided to the DAC 150 to perform a digital-to-analog convention. The DAC 150 is configured to convert the compensated display data to analog signal 151 according to the gamma reference voltages 141. The analog signal 151 is provided to the source buffer 160, and the source buffer outputs an analog display signal 161 to the display panel 170.

By analyzing the content of the display data (e.g. display load of the display data), the voltage drop amount and the data compensation value for compensating the voltage drop amount is determined. Once the display data is compensated with the calculated data compensation values to generate the compensated display data, the voltage drop across the supply power line is compensated, and the brightness uniformity over the entire display panel is achieved.

Figure 3B:
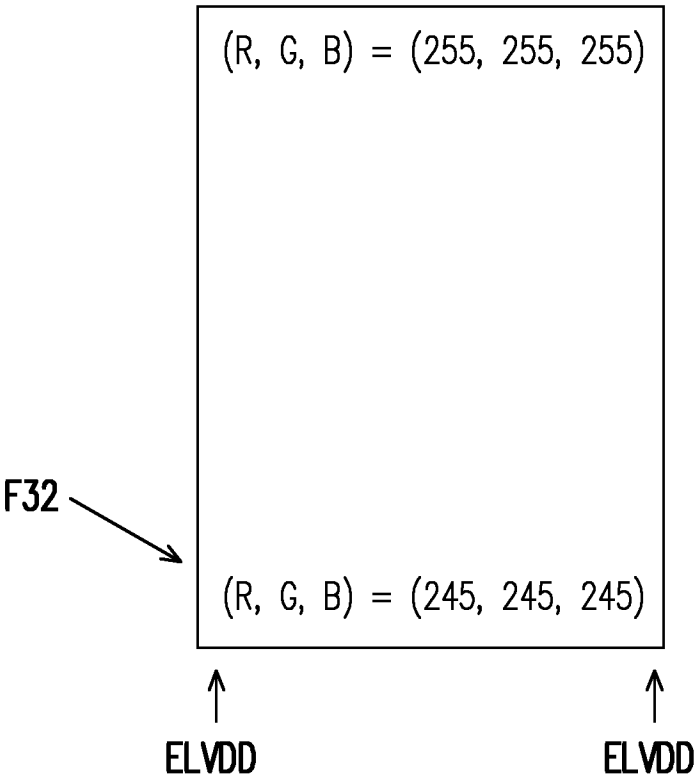
FIG. 3A to FIG. 3B illustrates examples of an uncompensated image frame and a compensated image frame according to an embodiment of the disclosure.
Figure 3A:
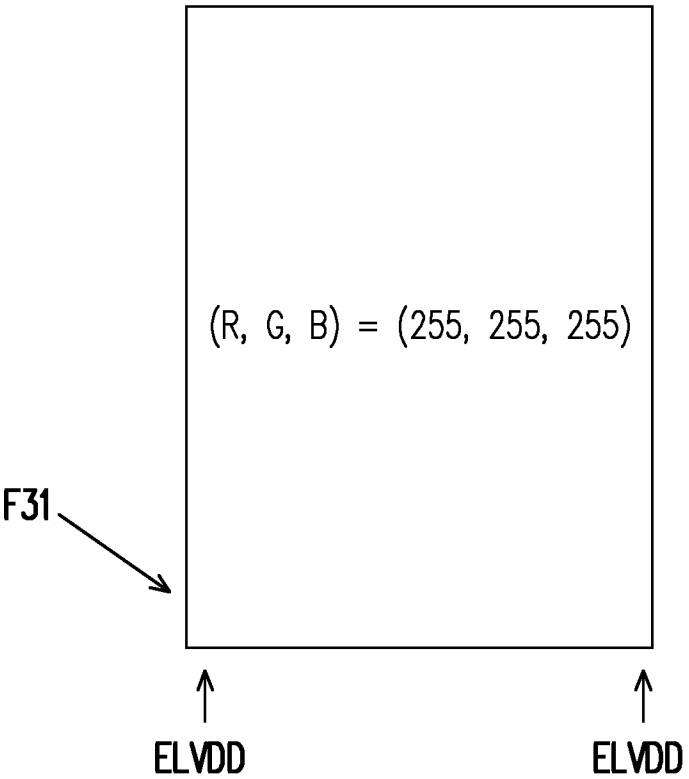

Referring to FIG. 3A and FIG. 3B, an uncompensated image frame F31 and a compensated image frame F32 are illustrated. In FIG. 3A, pixels located in a bottom area of the image frame F31 is closer to the power source ELVDD than pixels located in a top are of the image frame F31. Accordingly, the brightness of pixels in the bottom area of the image frame F31 is greater (brighter) than the brightness of pixels in the top area of the image frame F31 when the same display data (r=255, g=255, b=255) are displayed. One of the reasons for the above brightness non-uniformity is the voltage drop across the parasitic resistance of the supply power line. In FIG. 3B, the display data of each pixel in the compensated image frame in FIG. 3B is compensated with the corresponding compensation values stored in the compensation table LUT. As a result, the voltage drop across the supply power line is compensated, and the brightness informality in the image frame F32 is achieved.

Figure 4:
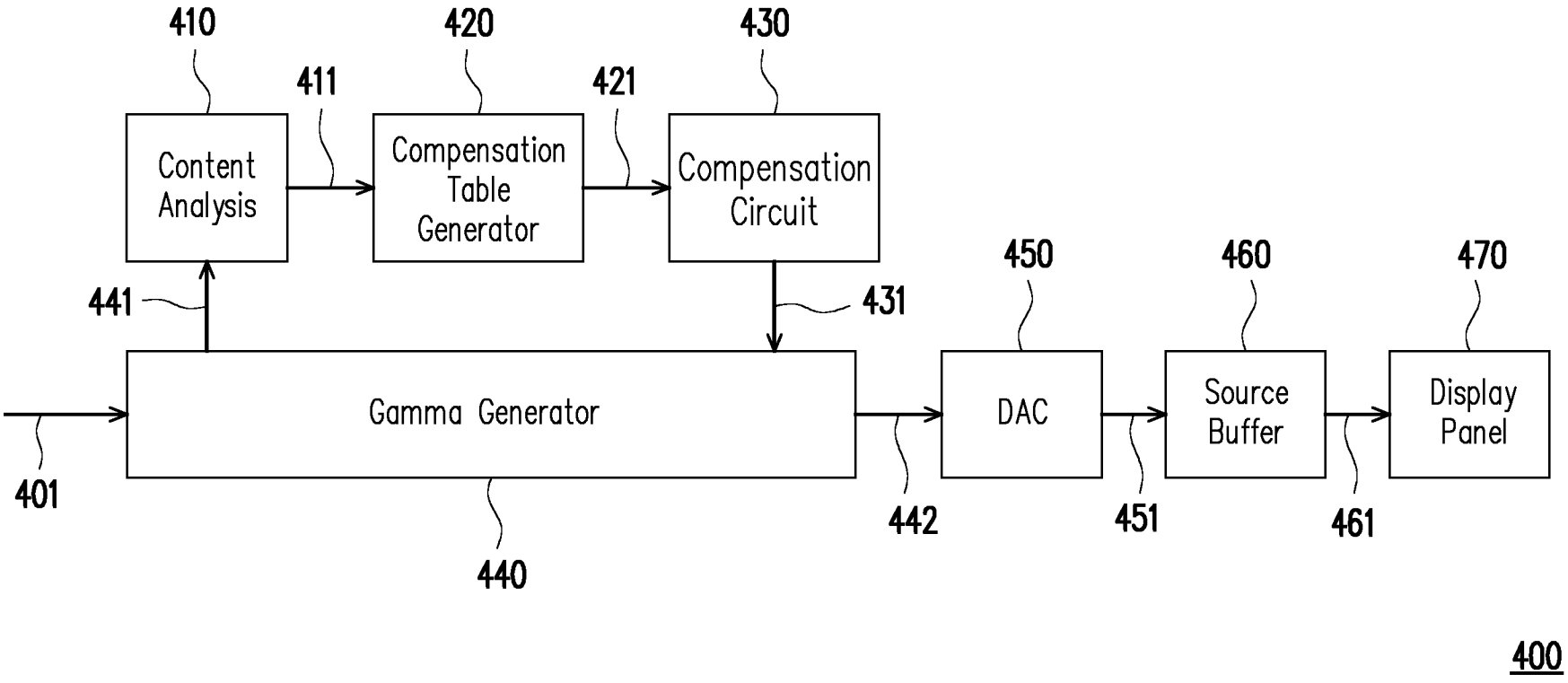
FIG. 4 illustrates a schematic diagram of a display apparatus according to another embodiment of the disclosure.

Referring to FIG. 4, a display apparatus 400 includes a content analysis circuit 410, a compensation table generator 420, a compensation circuit 430, a gamma generator 440, a DAC 450, a source buffer 460 and a display panel 470. The DAC 450, the source buffer 460 and the display panel 470 are similar to the DAC 150, the source buffer 160 and the display panel 170 in FIG. 1, thus the detailed description about these elements are omitted hereafter.

The content analysis circuit 410 is configured to analyze content (e.g., a display load) of display data 401 to generate the compensation value 411. The compensation value 411 is configured to compensate voltage drop across the parasitic resistance of the supply power line. The compensation table generator 420 may generate a compensation table (not shown) that stores the compensation value 411 for each pixel of the display panel 470. The compensation table generator 420 may output a compensation value 421 for each pixel of the display panel 470 to the compensation circuit 430, where the compensation value 421 may be the same as the compensation value 411. The compensation circuit 430 is coupled to the compensation table generator 420 and is configured to generate a plurality of compensated values 431 according to the compensation value 421. The gamma generator 440 may generate compensated gamma reference voltages 442 according to the compensated values 431, wherein the compensated gamma reference voltages 442 are used to generate compensated display data to be displayed on the display panel 470.

In an embodiment of the disclosure, the compensation values 411 and 421 are used to compensate gamma codes generated by the gamma generator 440. Particularly, the content analysis circuit 410 may analyze content (e.g., display load) of the display data 411 to generate the compensation value 411, where the compensation value 411 includes a plurality of gamma compensation values that are used to compensate the gamma codes generated by the gamma generator. The gamma compensation values for each of the pixels in the display panel 470 are stored in the compensation table generated by the compensation table generator. Next, the compensation circuit 430 compensates the gamma codes with the gamma compensation values to generate compensated gamma codes 431. For examples, the compensated gamma codes for a pixel (x, y) may be calculated according to the equations (4) and (5) as follows:

$$g1'(x,y)=g1+\Delta g1(x,y) \tag{4}$$

$$gn'(x,y)=gn+\Delta gn(x,y) \tag{5}$$

wherein g1' to gn' are the compensated gamma codes; g1 to gn are the gamma codes; and Δg1 to Δgn are gamma compensation values.

The compensated gamma codes 431 for a specific pixel of the display panel may be used to generate compensated gamma reference voltages for the specific pixel of the display panel; and the compensated gamma reference voltages are used to generate the compensated display data for brightness uniformity of the display panel 470.

In another embodiment of the disclosure, the compensation values 411 and 421 are used to compensate reference voltages of the gamma generator 440 to generate the compensated gamma reference voltage. Particularly, the content analysis circuit 410 may analyze content (e.g., display load) of the display data 411 to generate the compensation value 411, where the compensation value 411 includes a compensation voltage. The compensation voltage for each of the pixels in the display panel 470 is stored in the compensation table generated by the compensation table generator. Next, the compensation circuit 430 compensates reference voltage (first reference voltage and a compensated reference voltage) with the compensation voltage to generate a first compensated reference voltage and a second compensated reference voltage. For examples, the first compensated reference voltage and the second compensated reference voltage a pixel (x, y) may be calculated according to the equations (6) and (7) as follows:

$$V_{L/H}(y)=V_{L/H}+\Delta V_{L/H}(y) \tag{6}$$

$$V_{H/L}(y)=V_{H/L}+\Delta V_{H/L}(y) \tag{7}$$

Wherein the voltages $V_{L/H}(y)$ and $V_{H/L}(y)$ are the first and second compensated reference voltages; the voltages $V_{H/L}$ and $V_{H/L}$ are reference voltages; and the voltages $\Delta V_{L/H}(y)$ and $\Delta V_{H/L}(y)$ are the compensation voltages.

The compensated first and second compensated reference voltages for a specific pixel of the display panel may be used to generate compensated gamma reference voltages for the specific pixel of the display panel; and the compensated gamma reference voltages are used to generate the compensated display data for brightness uniformity of the display panel 470.

Figure 5:
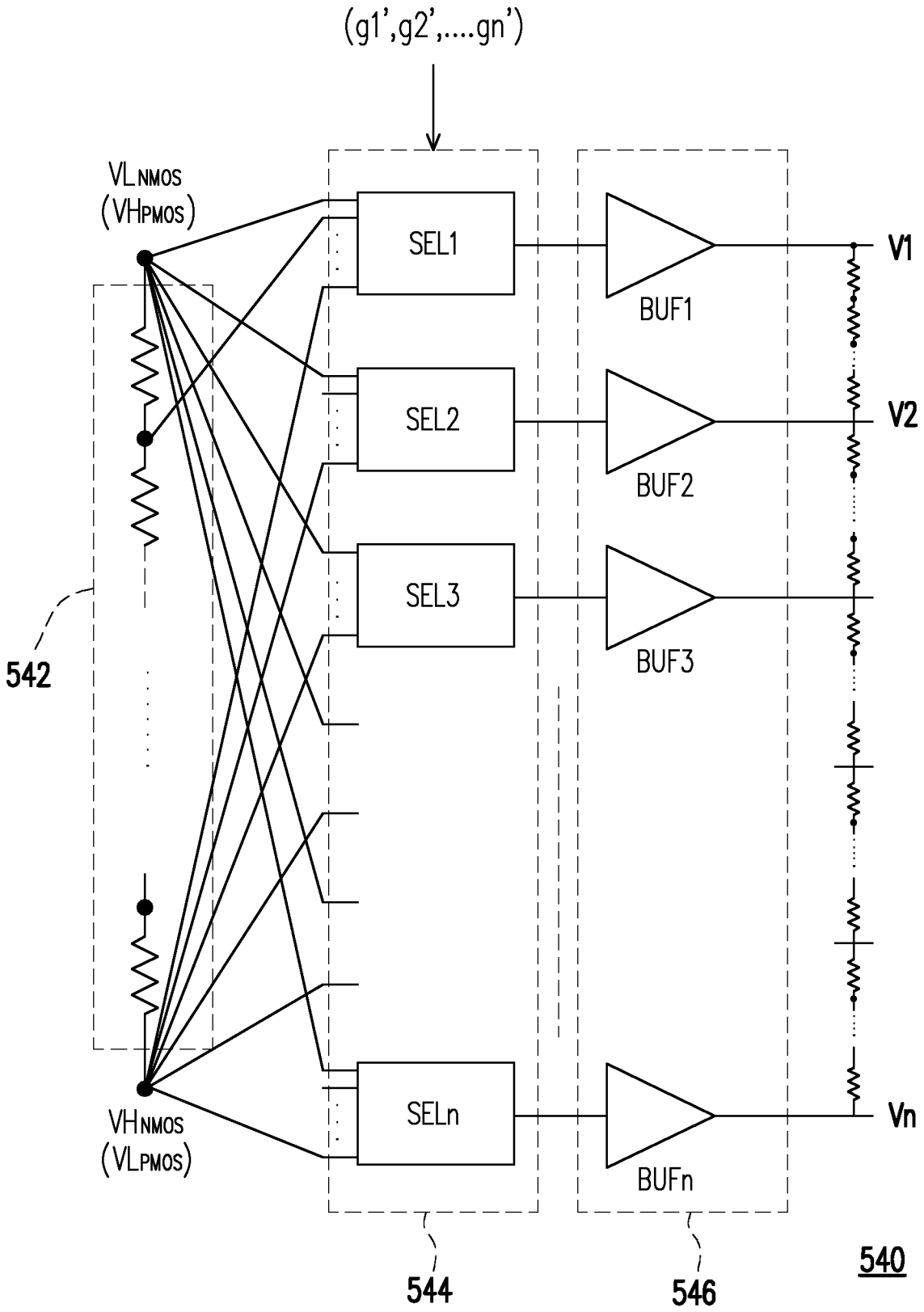
FIG. 5 illustrates a schematic diagram of a gamma generator according to an embodiment of the disclosure.

Referring to FIG. 5, a gamma generator 540 according to an embodiment of the disclosure is illustrated. The gamma generator 540 includes a resistance string 542, a selection circuit 544 and a buffer circuit 546. The resistance string 542 includes a plurality of resistance elements connected in series, wherein one end of the resistance string 542 receives a first reference voltage and another end of the resistance string 542 receives a second reference voltage. The first reference voltage is a low voltage ($VL_{PMOS}$) for Negative-Channel Metal Oxide Semiconductor (NMOS) display panel or a high voltage ($VH_{PMOS}$) for Positive-Channel Metal Oxide Semiconductor (PMOS) display panel; and the second reference voltage is a high voltage ($VH_{NMOS}$) for NMOS display panel; or a low voltage ($VL_{PMOS}$) for PMOS display panel.

The selection circuit 544 includes a plurality of selectors SEL1 to SELn, where each of the selectors SEL1 to SELn is configured to select a voltage from the resistance string 542 according to the compensated gamma codes g1' to gn', wherein n is a natural number. The buffer circuit 546 includes a plurality of buffers BUF1 to BUFn being coupled to the selectors SEL1 to SELn, respectively. The buffer circuit 546 is configured to buffer the selected voltages from the selection circuit 544 to output the gamma voltages V1 to Vn.

Figure 6B:
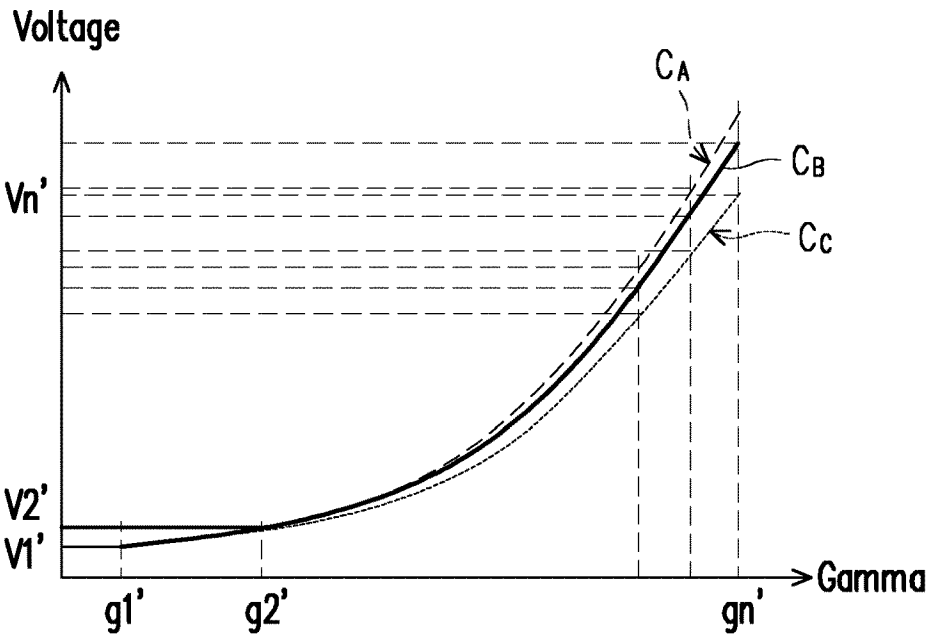
FIG. 6A to FIG. 6B illustrate examples of uncompensated image frame and gamma curves according to embodiments of the disclosure.
Figure 6A:
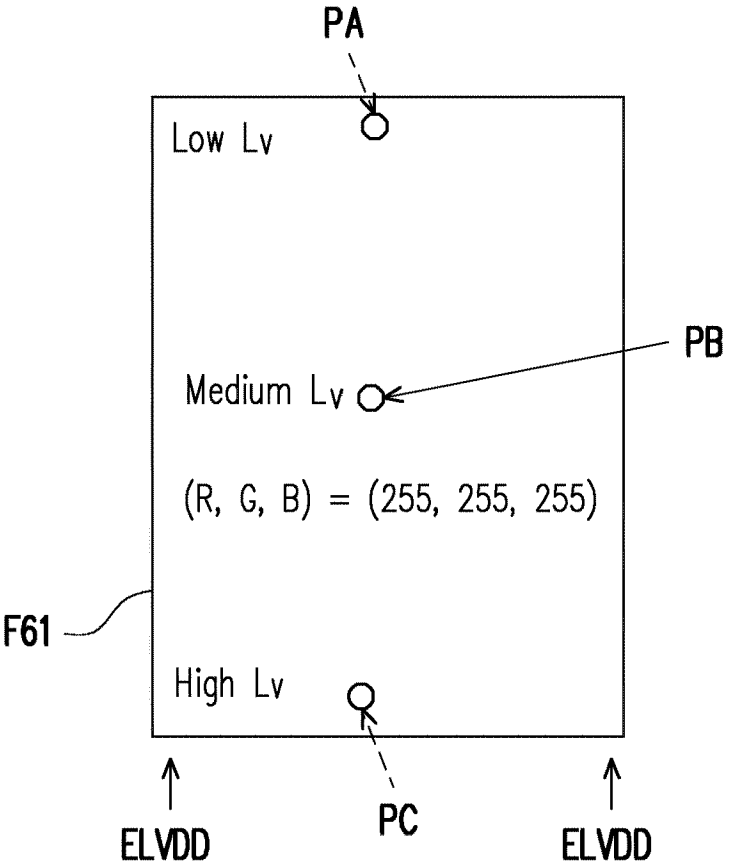

Referring to FIG. 6A, an uncompensated image frame F61 with the display data (r=255, g=255, b=255) is illustrated. Because of the voltage drop on the power supply line, the brightness (luminance) of the points PA, PB and PC are different. The point PA is located in a top area of the image frame (far away from the power supply source), the point PC is located in a bottom are of the image frame (close to the power supply source), and the point PB is located in a center area of the image frame. The brightness of the point PB is greater than the brightness of the point PA, and is less than the brightness of the point PC.

Figure 6E:
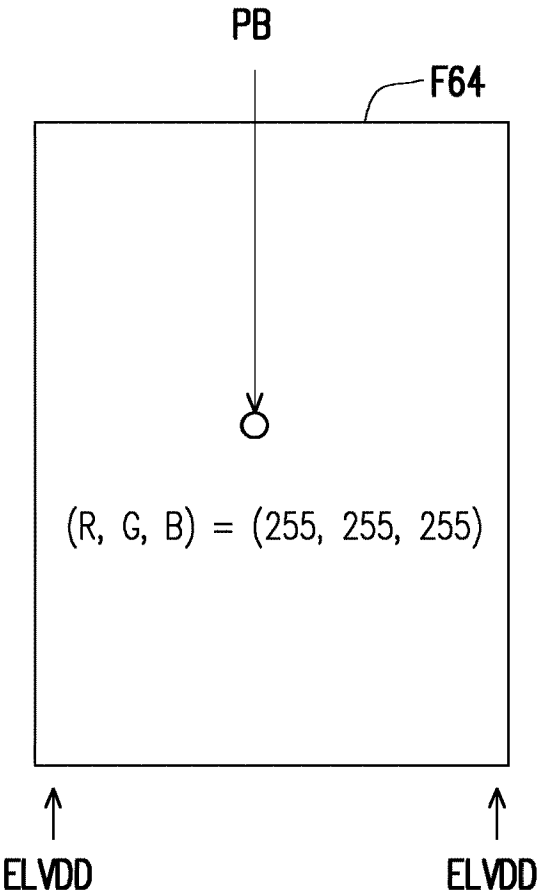
FIG. 6C to 6E illustrate examples of compensated frames according to embodiments of the disclosure.
Figure 6D:
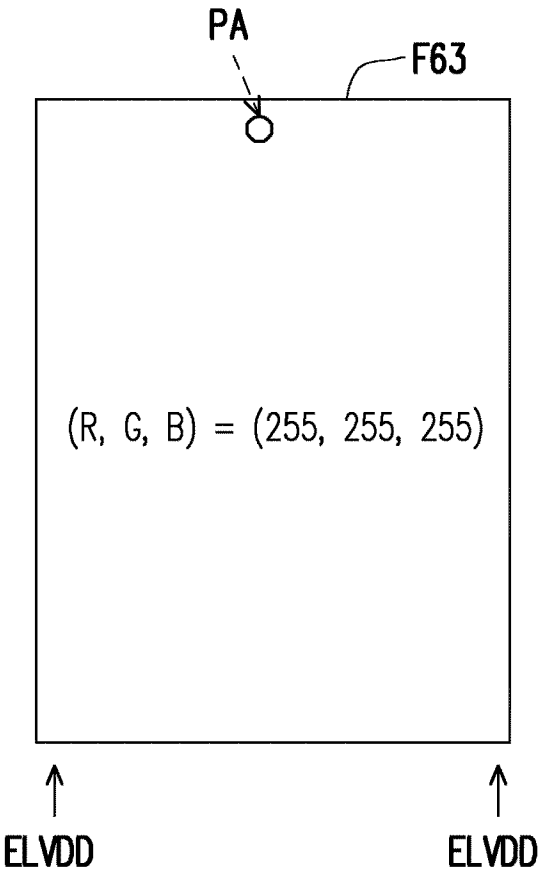
Figure 6C:
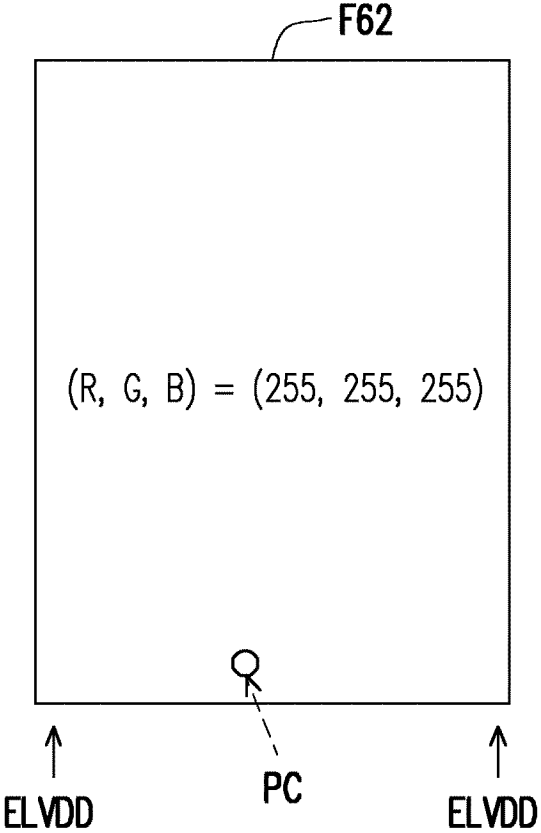

Referring to FIG. 6B to FIG. 6E, FIG. 6B illustrates gamma-voltage curves CA, CB, and Cc for the compensated image frames aligned with the points PA, PB, PC; and FIG. 6C to FIG. 6E illustrate compensated image frames F62, F63, F64 aligned with the brightness of the point PC, point PA and point PB, respectively.

Referring to FIG. 6B and FIG. 6C, if the gamma codes are compensated in an alignment with the brightness of point PC, the curve Cc corresponding to point PC is used. As shown in FIG. 6C, the brightness of pixel displaying the data (r=255, g=255, b=255) of the compensated image frame F62 are aligned with the brightness of the point PC displaying the data (r=255, g=255, b=255).

Referring to FIG. 6B and FIG. 6D, if the gamma codes are compensated in an alignment with the brightness of the point PA, the curve CA corresponding to point PA is used. As shown in FIG. 6D, the brightness of pixel displaying the data (r=255, g=255, b=255) of the compensated image frame F63 are aligned with the brightness of the point PA displaying the data (r=255, g=255, b=255).

Referring to FIG. 6B and FIG. 6E, if the gamma codes are compensated in an alignment with the brightness of the point PB, the curve CB corresponding to point PB is used. As shown in FIG. 6E, the brightness of pixel displaying the data (r=255, g=255, b=255) of the compensated image frame F64 are aligned with the brightness of the point PB displaying the data (r=255, g=255, b=255).

Figure 7:
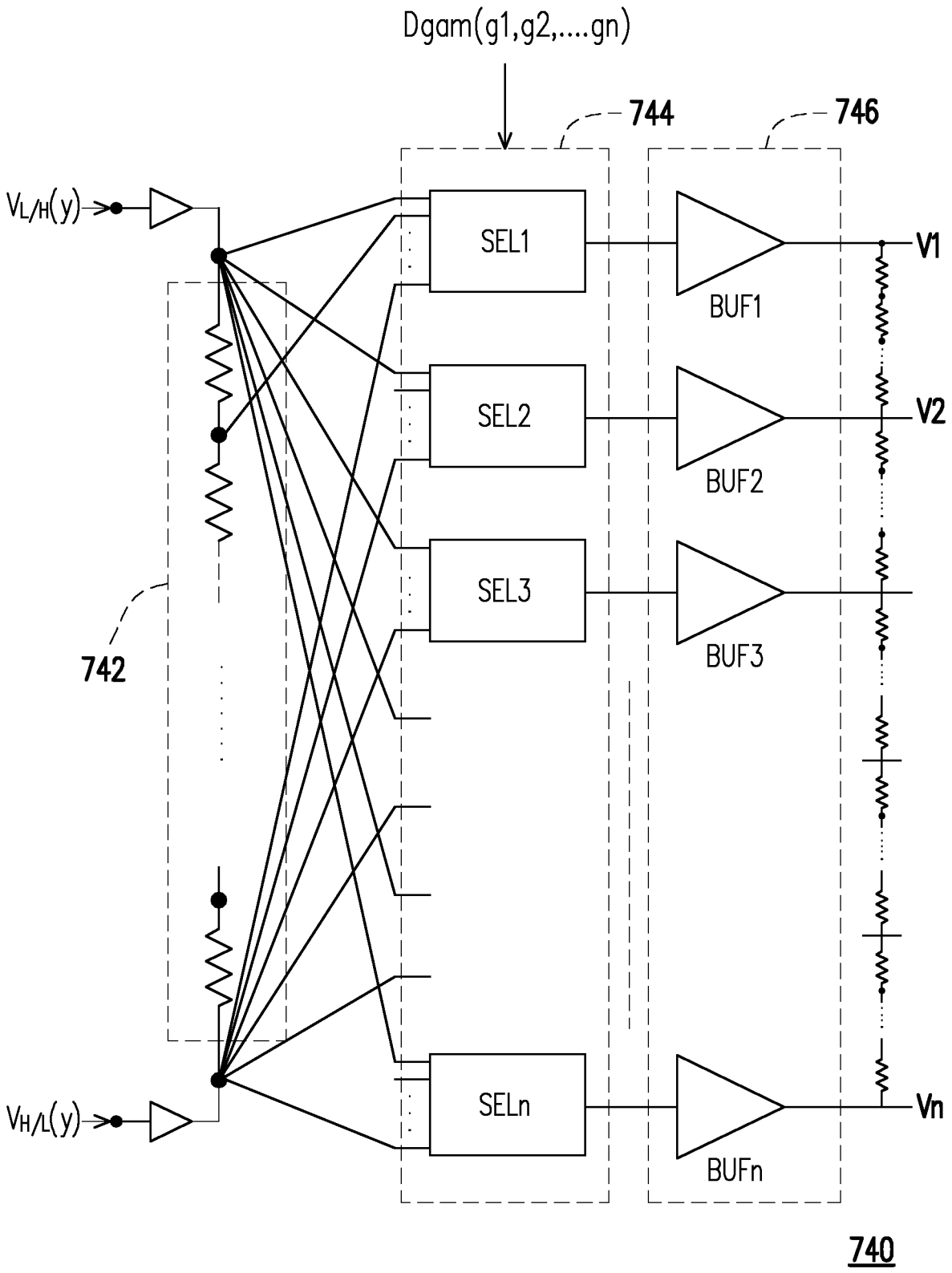
FIG. 7 illustrates a schematic diagram of a gamma generator according to an embodiment of the disclosure.

Referring to FIG. 7, an exemplary structure of the gamma generator 740 according to an embodiment of the disclosure illustrated. The structure of the gamma generator 740 is similar to the structure of the gamma structure 540 shown in FIG. 5, thus the detailed description is omitted hereafter. A difference between the gamma structure 740 and the gamma structure 540 is the voltages input to resistance string 742. Referring to FIG. 7, the voltage $V_{L/H}(y)$ input to the resistance string 742 is a compensated voltage $V_{L/H}(y)$ which is calculated according to the equation (6), and the voltage $V_{H/L}(y)$ input to the resistance string 742 is a compensated voltage $V_{H/L}(y)$ which is calculated according to the equation (7). In equations (6) and (7), the voltages $\Delta V_{L/H}(y)$ and $\Delta V_{H/L}(y)$ are the compensation voltages that are obtained by analyzing the content of the display data (e.g., r, g, b).

The gamma generator 740 receives the compensated reference voltages $V_{L/H}(y)$ and $V_{H/L}(y)$, and generates the compensated gamma reference voltages V1(*y*) to Vn(y) according to the compensated reference voltages $V_{L/H}(y)$ and $V_{H/L}(y)$.

Figure 8B:
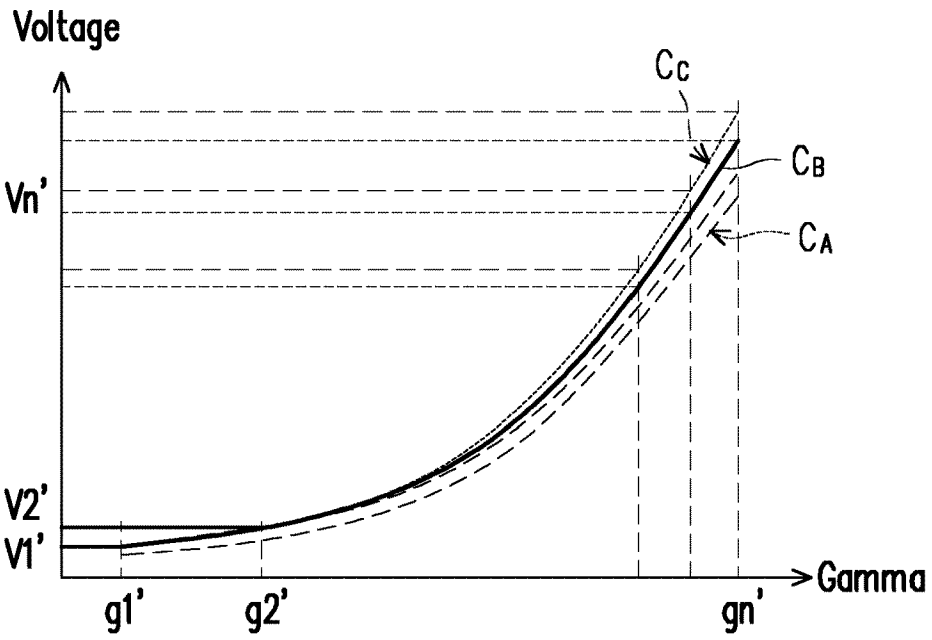
FIG. 8A to FIG. 8B illustrates illustrate examples of uncompensated image frame and gamma curves according to embodiments of the disclosure.
Figure 8A:
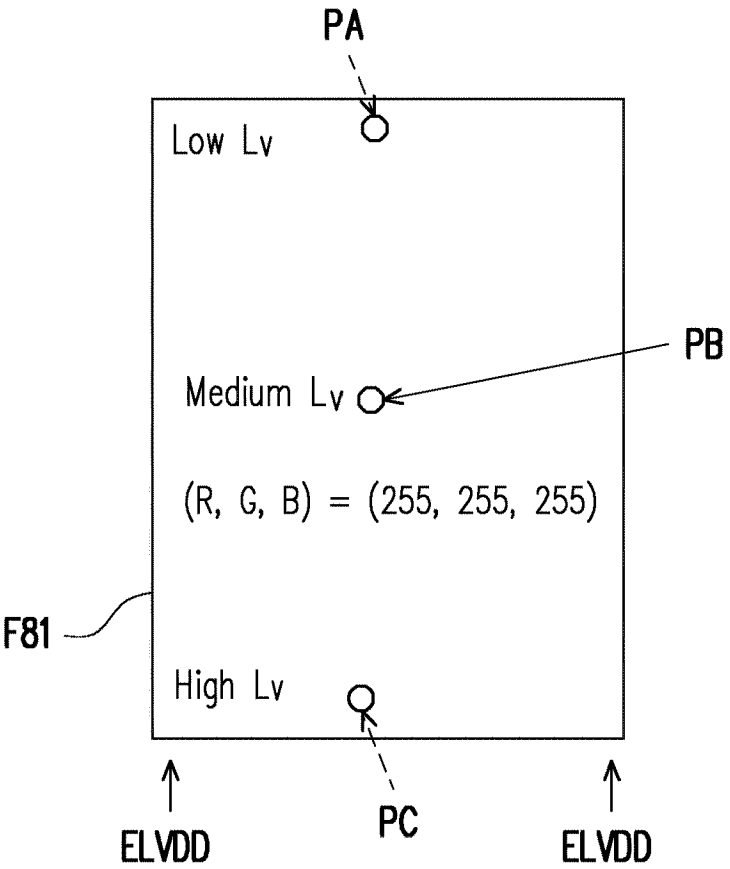

Referring to FIG. 8A, an uncompensated image frame F81 with display data (r=255, g=255, b=255) is illustrated. Because of the voltage drop on the power supply line, the brightness (luminance) of the points PA, PB and PC are different.

Referring to FIG. 8B to FIG. 8E, FIG. 8C to FIG. 8E illustrate compensated image frames F82, F83 and F84 aligned with the brightness of the point PC, point PA and point PB, respectively; and FIG. 8B illustrates gamma-voltage curves CA, CB, and CC for the compensated image frames aligned with the points PA, PB, PC.

Figures 8C, 8D, 8E:
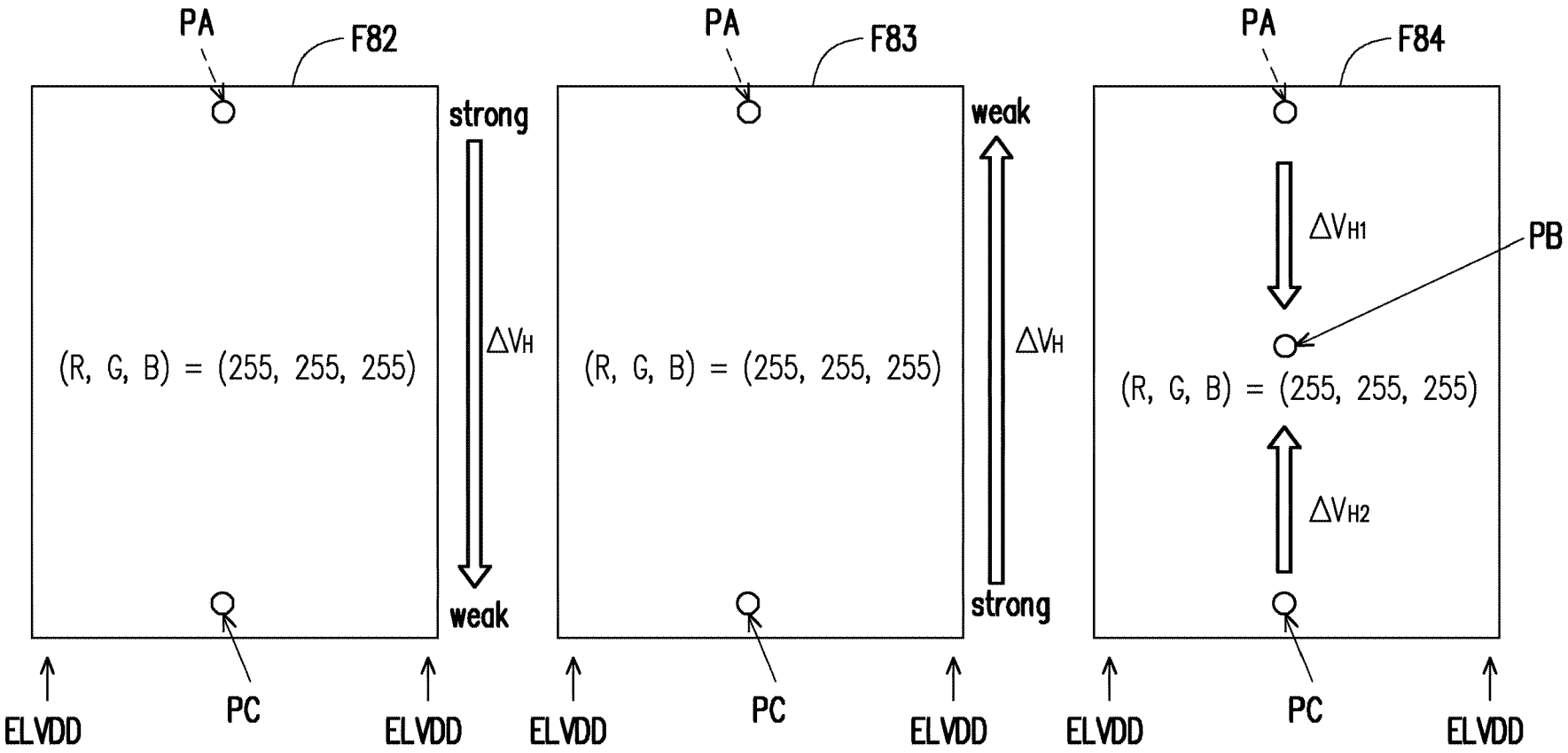
FIG. 8C to 8E illustrate examples of compensated frames according to embodiments of the disclosure.

Referring to FIG. 8B and FIG. 8C, the reference voltages are compensated in an alignment with the brightness of point PC, the curve Cc corresponding to point PC is used. As shown in FIG. 8C, the brightness of pixel displaying the data (r=255, g=255, b=255) of the compensated image frame F82 are aligned with the brightness of the point PC displaying the data (r=255, g=255, b=255). Since the reference voltages are compensated in the alignment with the brightness of point PC which is closed to the power source, the amount of the compensation voltage $\Delta V_H$ is greater for the farther pixels from the point PC.

Referring to FIG. 8B and FIG. 8D, if the gamma voltages are compensated in an alignment with the brightness of the point PA, the curve CA corresponding to point PA is used. As shown in FIG. 8D, the brightness of pixel displaying the data (r=255, g=255, b=255) of the compensated image frame F83 are aligned with the brightness of the point PA displaying the data (r=255, g=255, b=255). Since the reference voltages are compensated in the alignment with the brightness of point PA which is far from the power source, the amount of the compensation voltage $\Delta V_H$ is greater for the farther pixels from the point PA.

Referring to FIG. 8B and FIG. 8E, if the gamma voltages are compensated in an alignment with the brightness of the point PB, the curve CB corresponding to point PB is used. As shown in FIG. 8E, the brightness of pixel displaying the data (r=255, g=255, b=255) of the compensated image frame F84 are aligned with the brightness of the point PB displaying the data (r=255, g=255, b=255). Since the reference voltages are compensated in the alignment with the brightness of point PB, the amount of the compensation voltage $\Delta V_{H1}$ and $\Delta V_{H2}$ is different according to the location of the pixels to be compensated.

Figure 9:
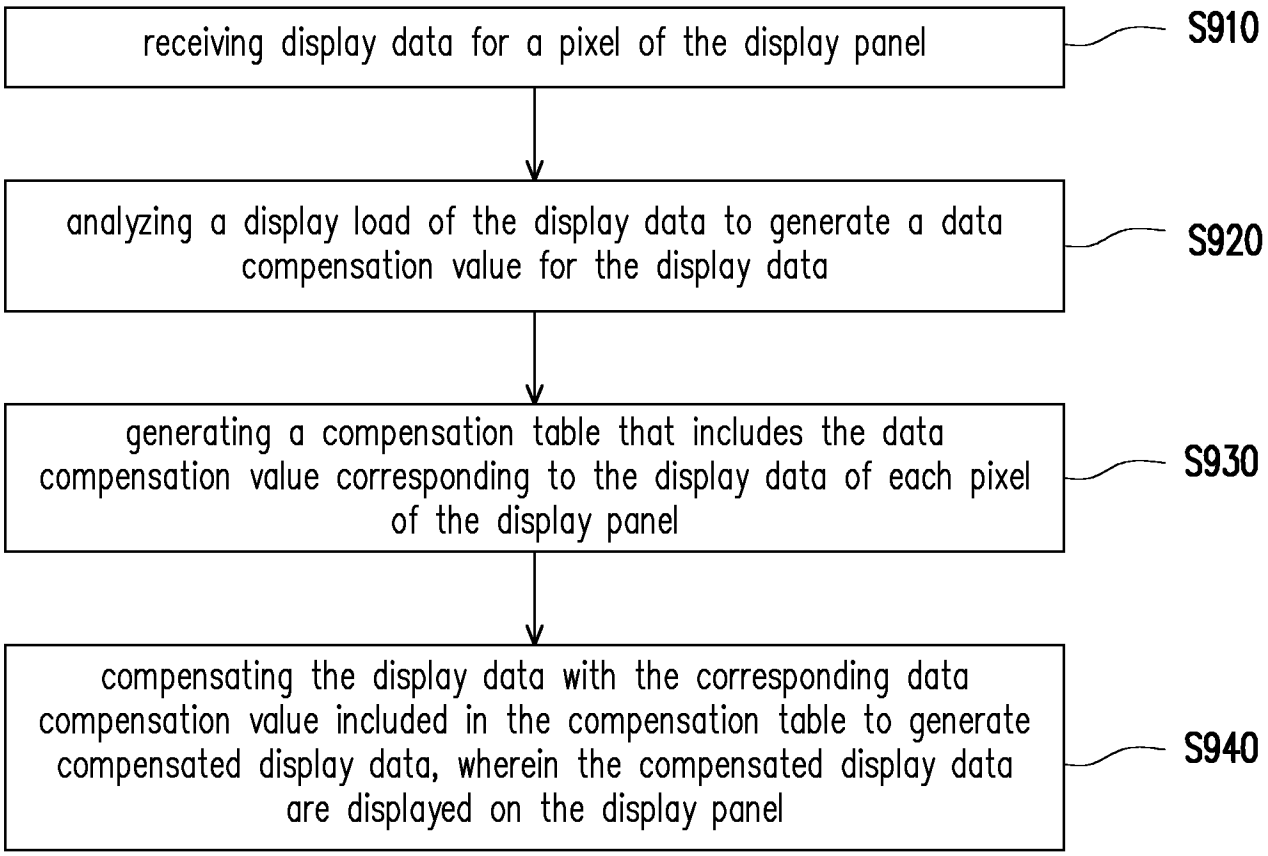
FIG. 9 illustrates a brightness uniformity compensation method according to an embodiment of the disclosure.

FIG. 9 illustrates a brightness uniformity compensation method according to an embodiment of the disclosure. In step S910, the display data for a pixel of the display panel is received. In step S920, a display load of the display data is analyzed to generate a data compensation value for the display data. In step S930, a compensation table that includes the data compensation value is generated corresponding to the display data of each pixel of the display panel. In step S940, the display data is compensated with the corresponding data compensation value included in the compensation table to generate compensated display data, wherein the compensated display data are displayed on the display panel.

Figure 10:
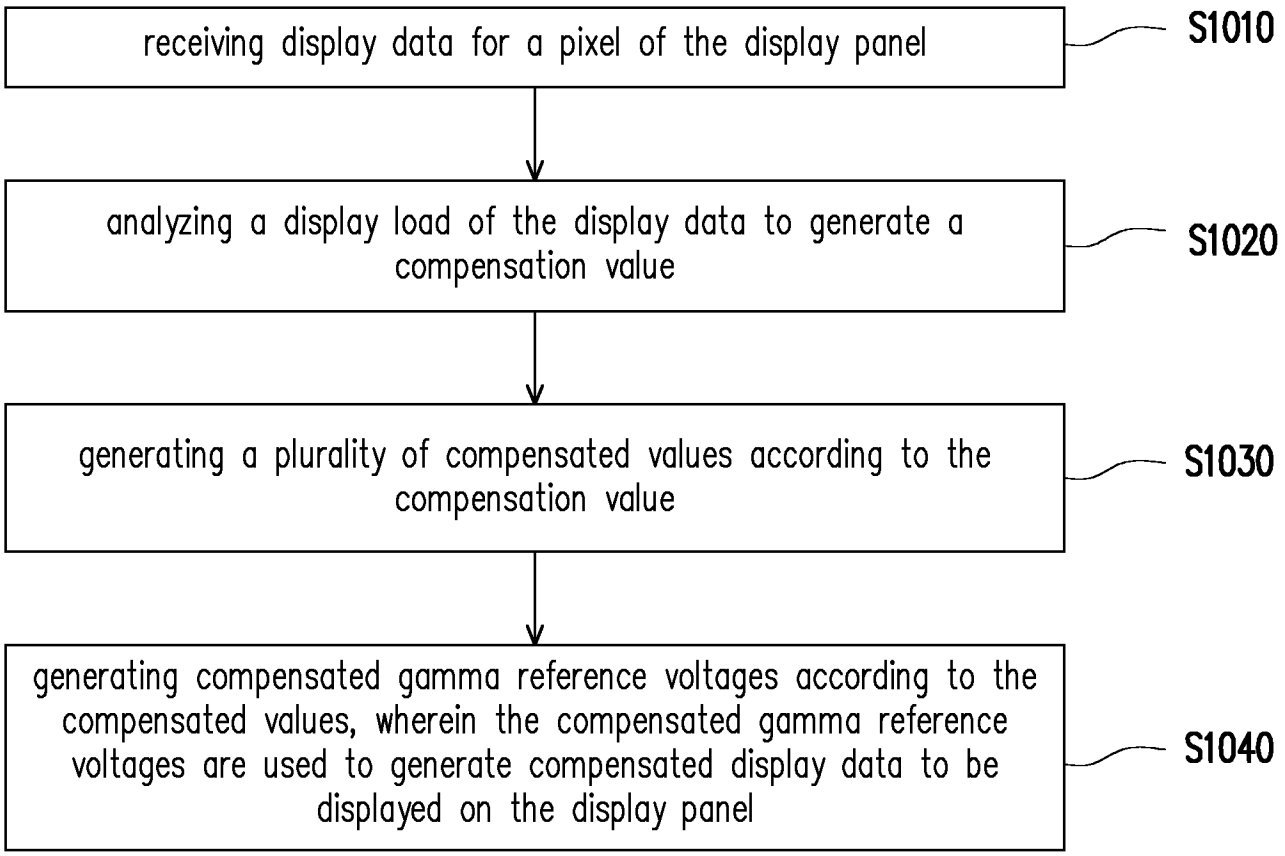
FIG. 10 illustrates a brightness uniformity compensation method according to another embodiment of the disclosure.

FIG. 10 illustrates a brightness uniformity compensation method according to another embodiment of the disclosure. In step S1010, the display data for a pixel of the display panel is received. In step S1020, a display load of the display data is analyzed to generate a compensation value. In step S1030, a plurality of compensated values are generated according to the compensation value. In step S1040, compensated gamma reference voltages are generated according to the compensated values, wherein the compensated gamma reference voltages are used to generate compensated display data to be displayed on the display panel.

From the above embodiments, compensation values for compensating brightness non-uniformity caused by voltage drop across the parasitic resistance of the supply power line is obtained by analyzing display data content (e.g., display load of the display data). The compensation values may be a data compensation values for compensating the display data of an image frame, or a gamma compensation values for compensating the gamma codes, or a compensation voltage for compensating the gamma voltages. As a result of the compensation, the voltage drop across the supply power line is compensated and the brightness uniformity over the entire display panel is achieved.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A display apparatus, comprising:

a display panel;

a content analysis circuit, determining a display load of display data to be displayed on a pixel of the display panel, and generating a compensation value for the pixel of the display panel according to the display load, wherein the display load is determined according to a parasitic resistance of a supply power line to a location of the pixel;

a compensation circuit, generating a plurality of compensated values according to the compensation value, a gamma generator, coupled to the compensation circuit, generating compensated gamma reference voltages according to the compensated values, wherein compensated display data to be displayed on the display panel is generated according to the compensated gamma reference voltages.

2. The display apparatus of claim 1, further comprising:

a compensation table generator, coupled to the content analysis circuit, generating a compensation table that includes the compensation values for each pixel of the display panel.

3. The display apparatus of claim 1, wherein the compensation value includes a plurality of gamma compensation codes and the compensated values are compensated gamma codes, and the gamma generator generates the compensated gamma reference voltages according to the compensated gamma codes.

4. The display apparatus of claim 3, wherein the gamma generator comprises:

a resistance string, comprising a first terminal and a second terminal for receiving reference voltages to generate a plurality of voltages;

a selection circuit, coupled to the resistance string, selecting voltages among the plurality of voltages from the resistance string according to the compensated gamma codes, and a buffer circuit, coupled to the selection circuit, configured to output the compensated gamma reference voltages.

5. The display apparatus of claim 1, wherein the compensation value includes a compensation voltage and the compensated values include a first compensated reference voltage and a second compensated reference voltage, and the gamma generator generates the compensated gamma reference voltages according to first compensated reference voltages and the second compensated reference voltages.

6. The display apparatus of claim 5, wherein the gamma generator comprises:

a resistance string, comprising a first terminal and a second terminal for receiving the first compensated reference voltage and the second compensated reference voltage, respectively;

a selection circuit, coupled to the resistance string, selecting voltages among the plurality of voltages from the resistance string according to gamma codes; and a buffer circuit, coupled to the selection circuit, configured to output the compensated gamma reference voltages.

7. The display apparatus of claim 1, further comprising:

a digital-to-analog converter, converting the compensated display data to an analog display signal, wherein the analog display signal is provided to the display panel.

8. The display apparatus of claim 1, wherein the compensation value is generated in alignment with a highest brightness value of display data.

9. The display apparatus of claim 1, wherein the compensation value is generated in alignment with a lowest brightness value of display data.

10. The display apparatus of claim 1, wherein the compensation value is generated in alignment with a brightness value of a center pixel, wherein the center pixel is located at a center position of the display panel.

11. A brightness uniformity compensation method, adapted to a display apparatus having a display panel, comprising:

receiving display data for a pixel of the display panel;

determining a display load of the display data to be displayed on a pixel of the display panel;

generating a compensation value for the pixel of the display panel according to the display load, wherein the display load is determined according to a parasitic resistance of a supply power line to a location of the pixel;

generating a plurality of compensated values according to the compensation value; and generating compensated gamma reference voltages according to the compensated values, wherein compensated display data to be displayed on the display panel is generated according to the compensated gamma reference voltages.

12. The brightness uniformity compensation method of claim 11, wherein the compensation value includes a plurality of gamma compensation codes and the compensated values are compensated gamma codes, and the compensated gamma reference voltages are generated according to the compensated gamma codes.

13. The brightness uniformity compensation method of claim 11, wherein the compensation value includes a compensation voltage and the compensated values include a first compensated reference voltage and a second compensated reference voltage, and the compensated gamma reference voltages are generated according to compensated reference voltages.

14. The brightness uniformity compensation method of claim 11, wherein the compensation value is generated in alignment with a highest brightness value of display data or a highest brightness value of display data or a brightness value of a center pixel, wherein the center pixel is located at a center position of the display panel.

* * * * *